United States Patent [19]

Ohsaki et al.

[11] Patent Number: 4,969,957

[45] Date of Patent: Nov. 13, 1990

[54] METHOD OF PRODUCING A MECHANICAL COMPONENT WITH SUPERIOR FATIGUE STRENGTH

[75] Inventors: Shigemi Ohsaki; Katsuya Ohuchi; Masami Nishida, all of Hiroshima; Shinya Yamamoto, Hatsukaichi, all of Japan

[73] Assignee: Mazda Motor Corporation, Hiroshima, Japan

[21] Appl. No.: 398,596

[22] Filed: Aug. 25, 1989

[30] Foreign Application Priority Data

Aug. 27, 1988 [JP] Japan ..... 63-213305

[51] Int. Cl.[5] ..... C21D 7/14

[52] U.S. Cl. ..... 148/12 R; 148/12 F

[58] Field of Search ..... 148/12 R

[56] References Cited

U.S. PATENT DOCUMENTS 4,406,711 9/1983 Nagumo ..... 148/12 R 4,720,307 1/1988 Matsumoto ..... 148/12 R

*Primary Examiner*—Peter D. Rosenberg

*Attorney, Agent, or Firm*—Sixbey, Friedman, Leedom & Ferguson

[57] ABSTRACT

A method of producing a mechanical component with superior fatigue strength comprises the steps of casting melted ferrous alloy which includes carbon within the range of 0.3% to 0.45% by weight, silicon within the range of 1.3% to 2.0% by weight, chromium within the range of 5.0% to 6.0% by weight, molybdenum within the range of 1.0% to 1.5% by weight, vanadium within the range of 0.8% to 1.2% by weight, manganese not more than 0.5% by weight, and iron of the major remainder, into an untreated mechanical component by the use of a casting mold formed through a lost-wax process; annealing the untreated mechanical component to produce an unfinished mechanical component; machining roughly the unfinished mechanical component having been annealed; quenching and tempering in sequence the unfinished mechanical component having been roughly machined; and finishing the unfinished mechanical component having been quenched and tempered to obtain a finished mechanical component.

6 Claims, 2 Drawing Sheets

METHOD OF PRODUCING A MECHANICAL COMPONENT WITH SUPERIOR FATIGUE STRENGTH

BACKGROUND OF THE INVENTION

1. Field of the Invention

The present invention relates to a method of producing a mechanical component with superior fatigue strength, such as a rocker arm used in a valve operating mechanism of an engine, through a process of casting ferrous alloy into an untreated mechanical component.

2. Description of the Prior Art

In the field of an overhead-camshaft engine, there has been proposed to use a roller rocker arm assembly which comprises a swingable rocker arm having a roller mounted thereon for transmitting rotary movements of each of cams provided on a camshaft to an intake or exhaust valve with the object of reducing friction resistance in a valve operating mechanism and thereby improving fuel consumption. In the valve operating mechanism which contains the roller rocker arm assembly and is provided in the overhead-camshaft engine, one end portion of the rocker arm constituting the roller rocker arm assembly is supported by a supporting portion provided on a cylinder head, such as a concave acceptor formed at the top of a hydraulic lash adjustor (HLA) fixed to the cylinder head, the other end portion of the rocker arm comes into contact with the top of a stem of the intake or exhaust valve, and the roller which is mounted on the middle portion of the rocker arm comes into contact with the cam provided on the camshaft. When the engine is operating, the roller of the roller rocker arm assembly is pushed down and rotated by the cam in accordance with the rotation of the camshaft and thereby the rocker arm is swung with a fulcrum positioned at the supporting portion provided on the cylinder head to transmit rotary movements of the cam to the intake or exhaust valve.

The rocker arm which constitutes the roller rocker arm assembly used as mentioned above in the valve operating mechanism of the overhead-camshaft engine is preferably required to have, as its mechanical properties, superior fatigue strength in its entirety, superior abrasion resistance particularly at the end portion thereof supported by the concave acceptor formed at the top of the HLA and another end portion thereof caused to come into contact with the top of the stem of the intake or exhaust valve, and superior accuracy in its dimension. Consequently, it has been also proposed to make the rocker arm of cement steel or ferrous alloy with superior abrasion resistance, such as standardized by the Japanese Industrial Standard JIS - G 4404 to be referred to as SKD61, through a lost-wax casting process.

However, when the rocker arm is made of cement steel through the lost-wax casting process, it is feared that melted cement steel cannot flow smoothly in a casting mold formed through a lost-wax process in process of casting so that a rocker arm obtained through a casting process is provided therein with a number of ingot pipings and thereby deteriorated in mechanical strength. For the purpose of preventing the rocker arm from having the ingot pipings, it is considered to carry out dead head in the casting process. However, in the case of the casting process for obtaining relative small casting works such as the rocker arms, generally, a plurality of casting molds are provided to be supplied with melted metallic material for casting simultaneously so as to produce a plurality of casting works at the same time, and therefore it is practically difficult to make the dead head effective actually to each of the casting molds.

Further, when the rocker arm is made of ferrous alloy such as standardized to be referred to as SKD61 through the lost-wax casting process, it is feared that a rocker arm obtained through casting process is provided with silicon-inclusions, oxygen-inclusions or the like caused to arise in grain boundaries contained in a part of a matrix structure of the ferrous alloy close to the surface thereof and thereby comes to fatigue failure or fatigue fracture resulted from the silicon-inclusions, oxygen-inclusions or the like positioned to be close to the surface when external force acts on the rocker arm.

OBJECTS AND SUMMARY OF THE INVENTION

Accordingly, it is an object of the present invention to provide a method of producing a mechanical component with superior fatigue strength, which avoids the aforementioned disadvantages and problems encountered with the prior art.

Another object of the present invention is to provide a method of producing a mechanical component with superior fatigue strength, by which a mechanical component which has superior fatigue strength and superior abrasion resistance and is prevented from being provided therein with ingot pipings and various inclusions arising in grain boundaries contained in a part of a matrix structure close to the surface thereof, is made of ferrous alloy with superior abrasion resistance through a lost-wax casting process.

A further object of the present invention is to provide a method of producing a rocker arm used in a valve operating mechanism of an engine, by which a rocker arm with superior fatigue strength and superior abrasion resistance is made of ferrous alloy with superior abrasion resistance through a lost-wax casting process without being provided therein with ingot pipings and various inclusions arising in grain boundaries contained in a part of a matrix structure close to the surface thereof.

According to the present invention, there is provided a method of producing a mechanical component with superior fatigue strength, the method comprising the steps of casting melted ferrous alloy which includes carbon within the range of 0.3% to 0.45% by weight, silicon within the range of 1.3% to 2.0% by weight, chromium within the range of 5.0% to 6.0% by weight, molybdenum within the range of 1.0% to 1.5% by weight, vanadium within the range of 0.8% to 1.2% by weight, manganese not more than 0.5% by weight, and iron of the major remainder, into an untreated mechanical component by the use of a casting mold formed through a lost-wax process; annealing the untreated mechanical component obtained by casting to produce an unfinished mechanical component; machining roughly the unfinished mechanical component having been annealed; quenching and tempering in sequence the unfinished mechanical component having been roughly machined; and finishing the unfinished mechanical component having been quenched and tempered in sequence to obtain a finished mechanical component.

In the method of the present invention as described above, the reason why the ferrous alloy used for casting the untreated mechanical component is selected to include carbon within the range of 0.3% to 0.45% by weight, silicon within the range of 1.3% to 2.0% by weight, chromium within the range of 5.0% to 6.0% by weight, molybdenum within the range of 1.0% to 1.5% by weight, vanadium within the range of 0.8% to 1.2% by weight, manganese not more than 0.5% by weight, and iron of the major remainder is explained as follows.

Carbon contributes to causing the melted ferrous alloy to flow smoothly in the casting mold in the process of casting and to improvement in hardness of the unfinished mechanical component having been subjected to the heat treatments. As a result of an experiment achieved by the inventors for determining a desirable carbon content in the ferrous alloy in consideration of the above mentioned character of carbon, it has been ascertained that the melted ferrous alloy does not flow smoothly in the casting mold so that the untreated mechanical component obtained by casting is provided therein with a number of ingot pipings and thereby deteriorated in mechanical strength and further the unfinished mechanical component having been quenched and tempered in sequence comes to be relatively low in hardness and inferior in abrasion resistance when the carbon content is less than 0.3% by weight, and it has been also ascertained that carbides which are crystallized in the ferrous alloy in the process of casting are coarsened so that the untreated mechanical component obtained by casting is reduced in toughness and insufficient in fatigue strength when the carbon content is more than 0.45% by weight. Accordingly, the carbon content in the ferrous alloy has been determined within the range of 0.3% by weight to 0.45% by weight.

Silicon acts as deoxdizing agent to the melted ferrous alloy and contributes to causing the melted ferrous alloy to flow smoothly in the casting mold in the process of casting and reinforcing matrix structure of the ferrous alloy in the untreated mechanical component. As a result of an experiment achieved by the inventors for determining a desirable silicon content in the ferrous alloy in consideration of the above mentioned character of silicon, it has been ascertained that the melted ferrous alloy is not effectively deoxidized and does not flow smoothly in the casting mold in the process of casting so that the untreated mechanical component obtained by casting is provided therein with oxygen-inclusions caused to arise in grain boundaries contained in a part of the matrix structure close to the surface thereof and thereby is reduced in fatigue strength when the silicon content is less than 1.3% by weight, and it has been also ascertained that grains in the matrix structure of the ferrous alloy in the untreated mechanical component obtained by casting are coarsened so that the untreated mechanical component is reduced in both toughness and hardness when the silicon content is more than 2.0% by weight. Accordingly, the silicon content in the ferrous alloy has been determined within the range of 1.3% by weight to 2.0% by weight.

Chromium contributes to improvement in hardenability of the unfinished mechanical component and acts with carbon to produce carbides by which the untreated mechanical component obtained by casing is increased in abrasion resistance. As a result of an experiment achieved by the inventors for determining a desirable chromium content in the ferrous alloy in consideration of the above mentioned character of chromium, it has been ascertained that the untreated mechanical component obtained by casting is not sufficient in hardness when the chromium content is less than 5.0% by weight and carbides contained in the untreated mechanical component are increased so that the untreated mechanical component is reduced in toughness when the chromium content is more than 6.0% by weight. Accordingly, the chromium content in the ferrous alloy has been determined within the range of 5.0% by weight to 6.0% by weight.

Molybdenum produces carbides by which the untreated mechanical component obtained by casting is increased in abrasion resistance and increases tempering-crack resistance of the unfinished mechanical component so as to improve mechanical strength of the unfinished mechanical composition at high temperature. As a result of an experiment achieved by the inventors for determining a desirable molybdenum content in the ferrous alloy in consideration of the above mentioned character of molybdenum, it has been ascertained that carbides are not produced sufficiently in the untreated mechanical component obtained by casting so that the untreated mechanical component is reduced in abrasion resistance and the unfinished mechanical component is not increased in temper-brittleness resistance when the molybdenum content is less than 1.0% by weight, and it has been also ascertained that the untreated mechanical component is reduced in both machinability and toughness when the molybdenum content is more than 1.5% by weight. Accordingly, the molybdenum content in the ferrous alloy has been determined within the range of 1.0% by weight to 1.5% by weight.

Vanadium produces carbides and contributes to making grains minute in the matrix structure of the ferrous alloy in the untreated mechanical component obtained by casting so that the untreated mechanical component is increased in toughness, and further contributes to improvement in tempering-crack resistance of the unfinished mechanical component. As a result of an experiment achieved by the inventors for determining a desirable vanadium content in the ferrous alloy in consideration of the above mentioned character of vanadium, it has been ascertained that the untreated mechanical component is not actually increased in toughness and the unfinished mechanical component is not actually improved in tempering-crack resistance when the vanadium content is less than 0.8% by weight and carbides which are crystallized in the matrix structure of the ferrous alloy in the untreated mechanical component are coarsened and enlarged so that the untreated mechanical component is reduced in toughness when the vanadium content is more than 1.2% by weight. Accordingly, the vanadium content in the ferrous alloy has been determined within the range of 0.8% by weight to 1.2% by weight.

Manganese which is contained in the ferrous alloy as an impurity element contributes to improvements in both abrasion resistance and mechanical strength of the untreated mechanical component obtained by casting. As a result of an experiment achieved by the inventors for determining a desirable manganese content in the ferrous alloy in consideration of the above mentioned character of manganese, it has been ascertained that the untreated mechanical component is reduced in toughness when the manganese content is more than 0.5% by weight. Accordingly, the manganese content in the ferrous alloy has been determined to be not more than 0.5% by weight.

In accordance with the method of the present invention, the untreated mechanical component is obtained by casting the ferrous alloy which includes silicon within the range of 1.3% to 2.0% by weight and other elements in such a manner as described above by the use of the casting mold formed through the lost-wax process. The untreated mechanical component thus obtained is prevented from being provided therein with ingot pipings and various inclusions arising in grain boundaries contained in a part of the matrix structure close to the surface thereof. The untreated mechanical component is subjected to the annealing process so as to be the unfinished mechanical component. Then, the unfinished mechanical component is subjected in sequence to the machining process, quenching and tempering process and finishing process so as to produce a finished mechanical component.

The finished mechanical component obtained in the manner as described above in accordance with the present invention, is not provided therein with ingot pipings nor various inclusions, such as silicon-inclusions, oxygen-inclusions or the like, arising in grain boundaries contained in a part of the matrix structure of the ferrous alloy close to the surface thereof, and thereby is superior in both abrasion resistance and fatigue strength.

The above and other objects, features and advantages of the present invention will become apparent from the following detailed description which is to be read in conjunction with the accompanying drawings.

DESCRIPTION OF THE PREFERRED EMBODIMENT

Figure 1:
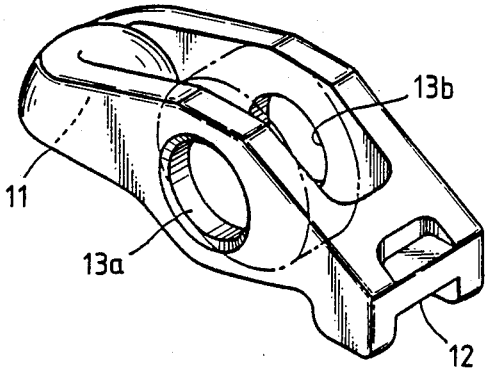
FIG. 1 is a perspective view showing a rocker arm which is produced through an embodiment of method of producing a mechanical component with superior fatigue strength according to the present invention.

Now, one embodiment of method of producing a mechanical component with superior fatigue strength according to the present invention, which is applied to production of a rocker arm, and the rocker arm produced through the embodiment will be described in detail.

In this embodiment, first, ferrous alloy which includes carbon (C) within the range of 0.3% to 0.45% by weight, silicon (Si) within the range of 1.3% to 2.0% by weight, chromium (Cr) within the range of 5.0% to 6.0% by weight, molybdenum (Mo) within the range of 1.0% to 1.5% by weight, vanadium (V) within the range of 0.8% to 1.2% by weight, manganese (Mn) not more than 0.5% by weight, and iron of the major remainder, is prepared. By way of example, three samples of the ferrous alloy X1, X2 and X3 having respective compositions as shown in Table 1 mentioned below are provided.

TABLE 1

| Components (% by weight) | Samples of Ferrous Alloy X1 | X2 | X3 |
|---|---|---|---|
| C | 0.35 | 0.341 | 0.34 |
| Si | 1.31 | 1.57 | 1.99 |
| Cr | 5.1 | 5.3 | 5.2 |
| Mo | 1.16 | 1.2 | 1.15 |
| V | 0.97 | 0.98 | 0.95 |
| Mn | 0.31 | 0.31 | 0.3 |
| P (Phosphorus) | 0.015 | 0.016 | 0.018 |
| S (Sulphur) | 0.011 | 0.011 | 0.009 |
| Fe | remainder | remainder | remainder |

Next, a casting mold which has been formed through a lost-wax process is prepared. In the lost-wax process for producing the casting mold, a wax model which is to be shaped coincidentally with the rocker arm is formed by pouring melted wax at temperature within the range of 68° C. to 80° C. in a metallic mold and cooling the wax in the metallic mold. The wax model shaped to be coincide with the rocker arm is steeped in investing solution with which powder of refractory material and caking agent are mixed, and then fire resistant sand is sprinkled over the wax model. Subsequently, the wax model which is covered by the fire resistant sand after being steeped in the investing solution is dried in a drying oven at about 26° C. The process from the step of steeping the wax model in the investing solution to the step of drying the wax model covered by the fire resistant sand is repeated several times to form a laminated shell covering the wax model.

After the laminated shell has been formed, the wax model covered by the laminated shell is heated at, for example, about 140° C. so that the wax model is melted away and the laminated shell is left independently. The laminated shell thus obtained is covered by refractory material and then the refractory material is sintered to form a casting mold. The sintering of the refractory material covering the laminated shell is carried out in a sintering furnace which is divided into the first zone heated at about 450° C., the second zone heated at about 600° C., the third zone heated at about 900° C. and the fourth zone heated at about 1050° C. through which the laminated shell covered by the refractory material is moved to pass successively.

Then, one of the samples of the ferrous alloy X1, X2 and X3, each of which has a melting point at about 1520° C., is melted and deoxdizing agent is added to the melted ferrous alloy for deoxidizing the latter. The melted ferrous alloy which has been deoxidized is poured into the casting mold, which is formed through the lost-wax process as mentioned above, at temperature within the range of 1,620° C. to 1,690° C. In such a process, the casting mold is maintained at temperature within the range of 900° C. to 1,000° C. Since the casting mold is maintained at such high temperature as that within the range of 900° C. to 1,000° C., the ferrous alloy is required to have its melting point at relatively high temperature for keeping superior fluidity in the casting mold, in a different manner from ordinary iron casting. Each of the samples of the ferrous alloy X1, X2 and X3 satisfies such requirement. Incidentally, the melting point of ferrous alloy depends on carbon content therein in such a manner that the smaller the carbon content is, the higher the melting point is.

After that, the melted ferrous alloy in the casting mold is cooled down to solidify into an untreated rocker arm. The untreated rocker arm is taken out of the casting case to be subjected to burring for the exterior thereof and then steeped in alkali aqueous solution to be subjected to so-called caustic treatment.

The untreated rocker arm having subjected to the caustic treatment is further subjected to shot blasting so that undesirable extraneous matter is removed from the exterior of the untreated rocker arm, and then is heated at about 860° C. for about about 3.5 hours continuously so as to be annealed and thereby turned into an unfinished rocker arm. The unfinished rocker arm thus annealed is roughly machined to be provided with, for example, a pair of opening with which a roller is to be engaged and then is heated in a vacuum furnace at about 1020° C. for about 40 minutes so as to be quenched. After that, The unfinished rocker arm having been subjected to quenching is maintained in a vacuum furnace at about 560° C. for about 100 minutes and then cooled in the ambient atmosphere of nitrogen gas so as to be subjected to tempering.

The unfinished rocker arm having been subjected to tempering as mentioned above is finished up to be tuned into a completed rocker arm.

FIG. 1 shows one example of rocker arms produced through the embodiment of method according to the present invention in such a manner as described above. The rocker arm shown in FIG. 1 has an engaging end portion 11 provided to be supported by a concave acceptor formed at the top of a HLA or the like, a contacting end portion 12 for coming into contact with the top of a stem of an intake or exhaust valve, and a pair of openings 13*a* and 13*b* for supporting the shaft of a roller. The roller is mounted on the rocker arm with its shaft inserted at both end portions thereof into the openings 13*a* and 13*b* respectively, as shown in dot-dash lines in FIG. 1, so that a roller rocker arm assembly is obtained.

The untreated rocker arm which is obtained in process of producing the rocker arm in accordance with the method of the present invention is prevented from being provided therein with ingot pipings and various inclusions arising in grain boundaries contained in a part of the matrix structure of the ferrous alloy close to the surface thereof.

Figure 2:
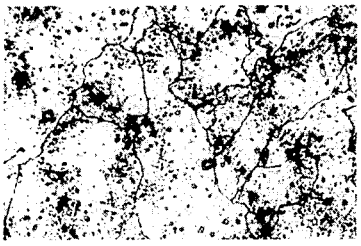
FIGS. 2 to 7 are microphotographs each showing an internal structure of an unfinished rocker arm obtained in process of an embodiment of method of producing a mechanical component with superior fatigue strength according to the present invention.
Figure 3:
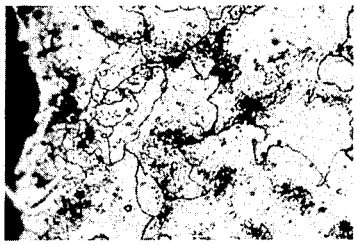
Figure 4:
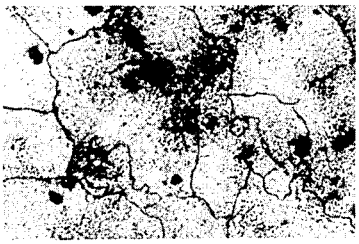
Figure 5:
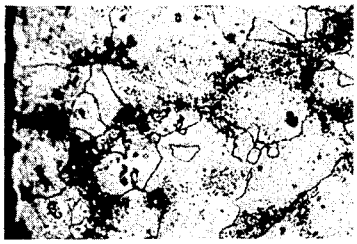
Figure 6:
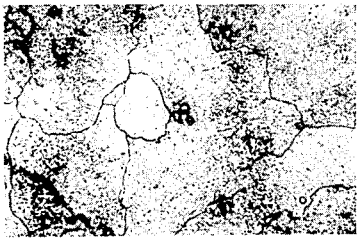
Figure 7:
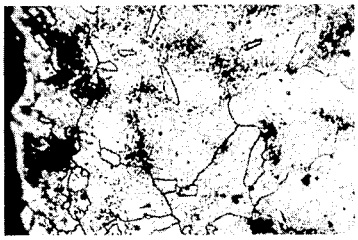

FIGS. 2 and 3, FIGS. 4 and 5, and FIGS. 6 and 7 show microphotographs of four hundred magnifications which represent internal structures at the inner portion and the surface portion of each of unfinished rocker arms which was made respectively of the samples of the ferrous alloy X1, X2 and X3 in accordance with the embodiment of method of the present invention aforementioned. In the microphotographs of FIGS. 2, 4 and 6, the internal structures of the inner portions of the rocker arms made of the samples of the ferrous alloy X1, X2 and X3, respectively, are shown, and no ingot piping is observed in each of the microphotographs of FIGS. 2, 4 and 6. In the microphotographs of FIGS. 3, 5 and 7, the internal structures of the surface portions of the rocker arms made of the samples of the ferrous alloy X1, X2 and X3, respectively, are shown, and no inclusion is observed in grain boundaries contained in the matrix structure of the ferrous alloy close to the surface of the rocker arm in each of the microphotographs of FIGS. 3, 5 and 7.

The rocker arm obtained based on each of the unfinished rocker arms made of the samples of the ferrous alloy X1, X2 and X3, respectively, in accordance with the embodiment of method of the present invention, is not provided therein with ingot pipings nor various inclusions, such as silicon-inclusions, oxygen-inclusions or the like, arising in grain boundaries contained in a part of the matrix structure close to the surface thereof, and thereby is superior in both abrasion resistance and fatigue strength.

It has been recognized that the rocker arms made of the samples of the ferrous alloy X1, X2 and X3 in accordance with the embodiment of method of the present invention are provided with hardness of HV=542, HV=530 and HV=530, respectively.

Now, comparison between the rocker arm made of the sample of the ferrous alloy X2 in accordance with the embodiment of method of the present invention (hereinafter, referred to as a rocker arm A2) and a rocker arm produced through a method other than the method according to the present invention to be shaped into the same figure as the rocker arm A2 (hereinafter, referred to as a rocker arm Sa) will be described below.

The rocker arm Sa was made of ferrous alloy including carbon of 0.36% by weight, silicon of 0.53% by weight, chromium of 5.11% by weight, molybdenum 1.21% by weight, vanadium of 0.96% by weight, manganese of 0.31% by weight, phosphorous of 0.002% by weight, sulphur of 0.009% by weight and iron of the remainder, through the method other than the method according to the present invention, by which treatments similar to those in the method according to the present invention were provided.

Figure 8:
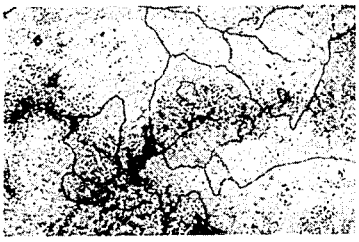
FIGS. 8 and 9 are microphotographs each showing an internal structure of an unfinished rocker arm obtained in process of a method other than the method of producing a mechanical component with superior fatigue strength according to the present invention.
Figure 9:
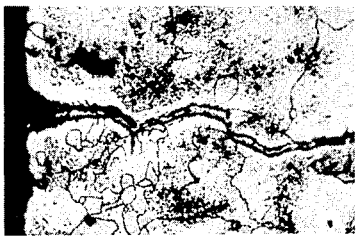

FIGS. 8 and 9 show microphotographs of four hundred magnifications which represent respectively internal structures at the inner portion and the surface portion of an unfinished rocker arm which was obtained in process of producing the rocker arm Sa and subjected to annealing (hereinafter, referred to as an unfinished rocker arm USa). In the microphotograph of FIG. 8 showing the internal structures at the inner portions of the unfinished rocker arm USa, no ingot piping is observed. However, in the microphotograph of FIG. 9 showing the internal structure at the surface portion of the unfinished rocker arm USa, silicon-inclusions or oxygen-inclusions which extend from the left side (the side of the surface) to the right side (the inside) are clearly observed.

For comparison in performance between the rocker arm A2 and the rocker arm Sa, a roller rocker arm assembly RA2 was obtained by mounting a roller on the rocker arm A2 in such a manner that both end portions of the shaft of the roller are inserted into a couple of opening on the rocker arm A2, a roller rocker arm assembly RSa was also obtained by mounting a roller on the rocker arm Sa in such a manner that both end portions of the shaft of the roller are inserted into a couple of opening on the rocker arm Sa, and then each of the roller rocker arm assemblies RA2 and RSa was subjected to a fatigue test.

Figure 10:
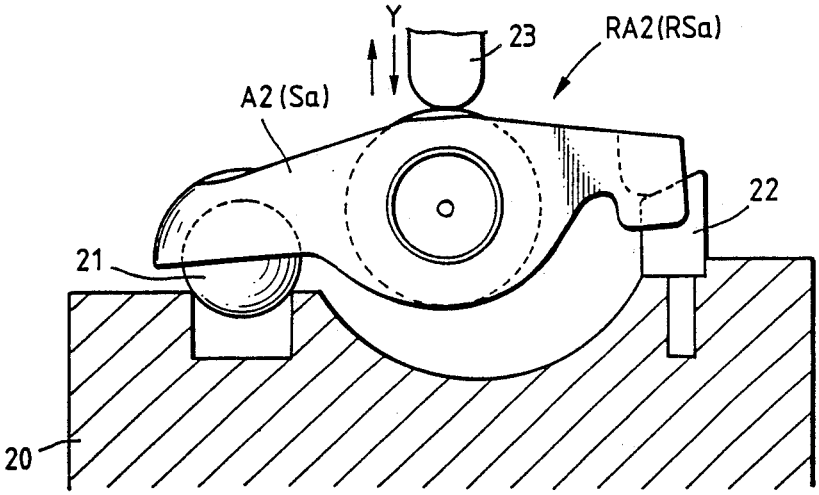
FIG. 10 is a schematic illustration used for explaining a fatigue test for a rocker arm.

In the fatigue test for each of the roller rocker arm assemblies RA2 and RSa, as shown in FIG. 10, an engaging end portion provided to be supported by a concave acceptor formed at the top of a HLA or the like and a contacting end portion for coming into contact with the top of a stem of an intake or exhaust valve of each of the rocker arms A2 and Sa were supported by a concave acceptor 21 fixed on the base 20 and a slant supporting member 22 fixed also on the base 20, respectively. Then, a pushing device 23 provided over each of the roller rocker arm assemblies RA2 and RSa was caused to push the roller down intermittently with press load Y at the rate of repetition of fifteen times per second. The press load Y was selected to be twice as large as press load assumed to act on the roller in the case where the roller rocker arm assembly RA2 or RSa is actually used.

As a result of such fatigue test, the rocker arm Sa with which the roller rocker arm assemblies RSa was constituted was broken down when the pushing device 23 pushed the roller repeatedly by $2.4\times10^6$ times, and to the contrary, the rocker arm A2 with which the roller rocker arm assemblies RA2 was constituted did not have any trouble after the pushing device 23 pushed the roller repeatedly by $1\times10^7$ times. As apparent from this result, it was recognized that the rocker arm A2 was much more superior in fatigue strength than the rocker arm Sa.

Although, in the aforementioned embodiment, the method of producing a mechanical component with superior fatigue strength according to the present invention is applied to production of a rocker arm, it is to be understood that the method according to the present invention can be also applied to production of various mechanical components required to have superior fatigue strength other than the rocker arm, such as a tappet used in a Diesel engine or the like.

What is claimed is:

1. A method of producing a mechanical component with superior fatigue strength, the method comprising the steps of:

casting melted ferrous alloy which includes carbon within the range of 0.3% to 0.45% by weight, silicon within the range of 1.3% to 2.0% by weight, chromium within the range of 5.0% to 6.0% by weight, molybdenum within the range of 1.0% to 1.5% by weight, vanadium within the range of 0.8% to 1.2% by weight, manganese not more than 0.5% by weight, and iron of the major remainder, into an untreated mechanical component by the use of a casting mold formed through a lost-wax process, annealing said untreated mechanical component obtained by casting to produce an unfinished mechanical component, machining roughly said unfinished mechanical component having been annealed, quenching and tempering in sequence said unfinished mechanical component having been roughly machined, and finishing said unfinished mechanical component having been quenched and tempered in sequence to obtain a finished mechanical component.

2. A method according to claim 1, wherein said untreated mechanical component, unfinished mechanical component and finished mechanical component are embodied by an untreated rocker arm, unfinished rocker arm and finished rocker arm, respectively.

3. A method according to claim 1, wherein said step of casting the melted ferrous alloy into the untreated mechanical component includes a process of pouring the melted ferrous alloy into the casting mold at temperature within the range of 1,620° C. to 1,690° C., a process of taking the untreated mechanical component out of the casting mold after the ferrous alloy in the casting mold is cooled down to solidify into the untreated mechanical component, and a process of steeping the untreated mechanical component in alkali aqueous solution to cause the untreated mechanical component to be subjected to caustic treatment.

4. A method according to claim 1, wherein said step of annealing the untreated mechanical component includes a process of heating the untreated mechanical component at temperature of about 860° C. for about 3.5 hours continuously.

5. A method according to claim 1, wherein said step of quenching and tempering in sequence the unfinished mechanical component includes a process of heating the unfinished mechanical component at temperature of about 1020° C. for about 40 minutes, a process of maintaining the unfinished mechanical component, which has been heated at about 1020° C. for about 40 minutes, at about 560° C. for about 100 minutes, and a process of cooling the unfinished mechanical component, which has been maintained at temperature of 560° C. for about 100 minutes, in the ambient atmosphere of nitrogen gas.

6. A method according to claim 5, wherein each of said process of heating the unfinished mechanical component at about 1020° C. for about 40 minutes and said process of maintaining the unfinished mechanical component at about 560° C. for about 100 minutes is carried out in a vacuum furnace.

* * * * *